US006372674B1

(12) United States Patent
Lack

(10) Patent No.: US 6,372,674 B1
(45) Date of Patent: Apr. 16, 2002

(54) WRINKLE FREE-WATER RESISTANT FABRICS AND GARMENTS

(75) Inventor: Ronnie Franklin Lack, Mize, MS (US)

(73) Assignee: Warmkraft, Inc., Taylorsville, MS (US)

( * ) Notice: Subject to any disclaimer, the term of this patent is extended or adjusted under 35 U.S.C. 154(b) by 0 days.

(21) Appl. No.: 09/388,738

(22) Filed: Sep. 2, 1999

(51) Int. Cl.[7] ..... B32B 9/04; B32B 27/04; B32B 27/12; B32B 5/02

(52) U.S. Cl. ..... 442/153; 442/93; 442/104; 442/107; 442/152; 442/164; 442/165; 427/400; 427/430.1; 427/393.2; 427/393.4; 8/115.51; 8/116.1; 8/195

(58) Field of Search ..... 442/93, 104, 107, 442/152, 153, 164, 165; 427/400, 430.1, 393.2, 393.4; 8/115.51, 116.1, 195

(56) References Cited

U.S. PATENT DOCUMENTS

| | | | | |
|---|---|---|---|---|
| 4,562,097 A | * 12/1985 | Walter et al. | ..... | 427/209 |
| 5,614,591 A | 3/1997 | Basinger et al. | ..... | 525/163 |
| 5,856,245 A | 1/1999 | Caldwell et al. | ..... | 442/76 |
| 5,869,172 A | 2/1999 | Caldwell | ..... | 428/306.6 |
| 5,874,164 A | 2/1999 | Caldwell | ..... | 428/306.6 |
| 5,912,116 A | 6/1999 | Caldwell | ..... | 435/5 |

FOREIGN PATENT DOCUMENTS

| | | |
|---|---|---|
| WO | WO99/49124 | 9/1999 |
| WO | WO99/49125 | 9/1999 |

OTHER PUBLICATIONS

DuPont, About Dupont Zonyl ©Fluroadditives, pp. 1–3.*
DuPont, Zonyl ©–Flurosurfactant, pp. 1–4.*

* cited by examiner

*Primary Examiner*—Terrel Morris
*Assistant Examiner*—Norca L. Torres
(74) *Attorney, Agent, or Firm*—Volpe and Koenig, P.C.

(57) ABSTRACT

A textile treatment process, treatment bath, and treated fabric are disclosed. The process imparts water repellant, stain resistant, and wrinkle-free properties as well as aesthetically pleasing hand properties to a fabric made in whole or in part of fibers having a hydroxyl group, such as cellulosic fibers, though immersion in an aqueous bath and subsequent heating for curing. The aqueous treatment bath contains 8%–14% urea resin, preferably DMDHEU, and 4%–10% of a polytetrafluorethylene, preferably ZONYL® PTFE.

18 Claims, 1 Drawing Sheet

WRINKLE FREE-WATER RESISTANT FABRICS AND GARMENTS

BACKGROUND OF THE INVENTION

1. Field of the Invention

The present invention relates to the treatment of textiles, and more particularly to a treatment process and composition which provides a fabric having water repellant, stain resistant, and wrinkle-free properties. Most particularly, the present invention relates to water repellant, stain resistant, and wrinkle-free fabrics which display excellent hand and feel.

2. Description of the Related Art

Various types of processes for the treatment of textiles are well known in the art. U.S. Pat. No. 5,614,591 discloses an example of a durable press process which combines a modified ethylene urea resin, a crosslinking acrylic copolymer, and a catalyst to provide durable press properties to the fabric.

U.S. Pat. No. 5,856,245 discloses an example of a barrier web comprising a fabric that has been treated with a curable shear thinned thixotropic polymer composition, the fabric being substantially impermeable to liquids, permeable to gases and impermeable to all microorganisms.

U.S. Pat. No. 5,869,172 discloses an example of processes for treating a porous substrate which involves controlled placement of modifiers through the manipulation of chemical and physical properties inherent in the modifiers to produce internally coated porous materials. The treatment involves impregnating the porous substrate with a curable thixotopic material and one or more modifying materials to impart desired properties.

U.S. Pat. Nos. 5,874,164 and 5,912,116 provide examples of a barrier web comprising a fabric that has been treated with a curable shear thinned thixotropic polymer composition. The fabric is substantially impermeable to liquids, permeable to gases and impermeable to all microorganisms. The barrier webs are either impermeable to all microorganisms or are impermeable to microorganisms of certain sizes. These patents also disclose fabrics that are capable of selectively binding certain microorganisms, particles or molecules depending upon the binding agents incorporated into the polymer before application to the fabric.

SUMMARY

The present invention is directed to a textile treatment process that imparts water repellant, stain resistant, and wrinkle-free properties as well as aesthetically pleasing hand properties to a fabric made in whole or in part of fibers having a hydroxyl group, such as cellulosic fibers. The present invention is also directed to the resultant fabric of the process.

The fabrics are treated by immersion into an aqueous bath. The fabrics are then preferably dried to their natural regain, and pressed to remove unwanted wrinkles. Thereafter heat is applied to cure the reactants. The bath contains 8–14% of a urea resin, preferably DMDHEU, and 4–10% polytetrafluorethylene, preferably ZONYL® PTFE. A bonding reaction between the urea resin and the hydroxyl group on the fabric is initiated upon immersion of the fabric and strengthened when heat is applied during the drying and curing processes. Preferably the bath contains a buffer to maintain pH in a range of 5–5.5 and a catalyst to speed the reaction.

Objects and advantages of the present invention will become more readily apparent to those skilled in the art upon consideration of the following detailed description which describes a preferred embodiment of the invention.

DETAILED DESCRIPTION OF THE PREFERRED EMBODIMENTS

Figure 1:
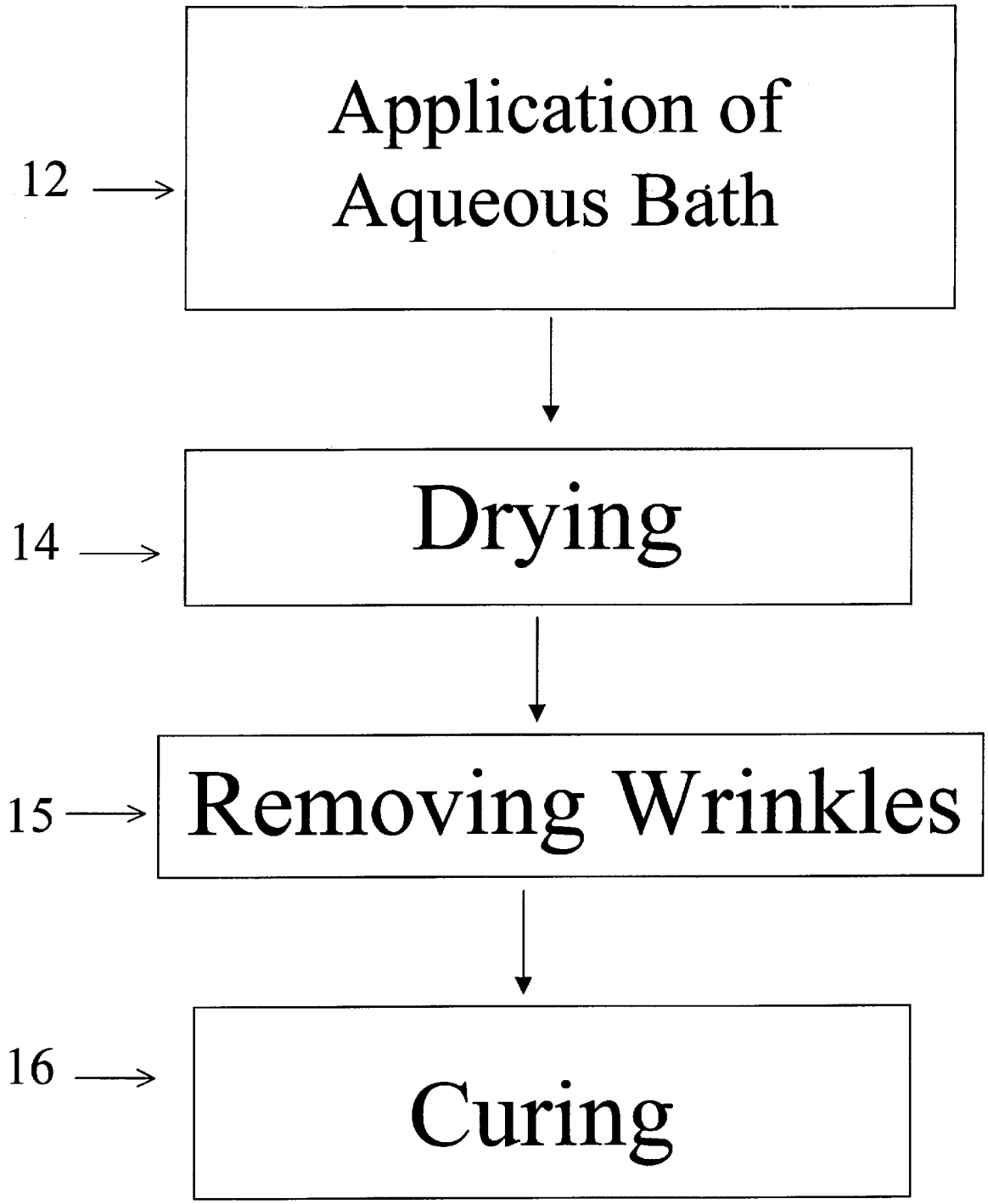
FIG. 1 is a schematic illustration of the textile treatment process according to the invention.

The present invention is directed to a water repellant, stain resistant, breathable, wrinkle-free fabric which retains the hand and feel of the untreated textile. The fabric is prepared by treating a textile made with preferably at least 10% fibers which have a hydroxyl group such as cellulosic fibers. The textile is immersed in a bath having a unique combination of urea resin and polytetrafluorethylene which reacts with cellulosic fabric fibers and is cured on the fabric to form a polymer network.

The aqueous treatment bath contains a reactive modified ethylene urea resin such as dimethylol dihydroxy ethylene urea (DMDHEU). The amount of modified ethylene urea resin used in the treatment bath preferably ranges from 8 to 14 percent by weight. The amount of fluorochemical copolymer polytetrafluorethylene used in the treatment bath preferably ranges from 4 to 10 percent by weight. The preferred fluorochemical copolymer polytetrafluorethylene used in the process is ZONYL® PTFE which is commercially available from E.I. du Pont de Nemours and Company or in premixed form from commercial vendors.

The aqueous bath preferably also includes one or more additives selected from a group of buffering agents and catalysts. Buffering agents help control the acidity, or pH, of the bath and help reduce tendering of the fabric. Typical buffering agents include acetic acid, citric acid, maleic acid, and other suitable weak acids. The buffering agent is used to adjust the pH to a preferred range of 5–5.5. A catalyst can be used to help speed the reaction so that a simple immersion technique can be used during the treatment process instead of prolonged saturation of the fabric and to reduce curing time. Typical catalysts that can be used are parabolic catalysts such as magnesium chloride or aluminum chloride.

Since the preferred ZONYL® PTFE is a powder, a liquid premix containing the ZONYL® PTFE can be used in preparing the aqueous bath. Premixed products which include a suspension agent and a surfactant, are preferred to allow the ZONYL® PTFE to readily mix with the modified ethylene urea resin. On a weight percent basis, the treatment bath may contain 1 to 2% hexylene glycol as a suspension agent, and 0.5 to 1.5% ethoxylated aliphatic alcohol as a surfactant. The premixed combination of polytetrafluorethylene (ZONYL® PTFE), with hexylene glycol and ethoxylated aliphatic alcohol is commercially available as ZONYL® FMX which is commercially available from Ciba Specialty Chemicals Corporation in High Point, N.C.

The fabrics treated in the bath are made at least in part of fibers which contain hydroxyl groups which act as a binding site for the urea resin. One type of hydroxyl containing fibers are cellulosic fibers which include natural fibers such as cotton and synthetic materials such as rayon. Accordingly, fabrics made of cotton, rayon and cotton and rayon blends are suitable for treatment using the inventive process. When the textile is immersed in the treatment bath, the dimethylol dihydroxy ethylene urea (DMDHEU) reacts with the hydroxyl groups of fibers and acts as a binding site for the urea resin. The binding or crosslinking of the 1 groups and the urea resin enhance the adhesion of the polytetrafluorethylene (ZONYL® PTFE). The combination of these components results in a synergistic effect in which the fabric displays water resistant, stain resistant, and wrinkle-free properties while maintaining excellent hand.

FIG. 1 schematically illustrates the process of the present invention by which fabrics having cellulosic fibers are treated to impart water repellant, stain resistant, and wrinkle-free properties. First the aqueous treatment bath is prepared and the fabric is immersed in the bath or otherwise applied using conventional means 12. The fabric is then dried 14 to its natural regain. Where the immersion and drying steps result in wrinkling of the fabric, pressing 15 is then conducted to remove the wrinkles. Finally, the fabric is heated 16 to cure the treated fabric to impart water repellant, stain resistant, and wrinkle-free properties to the fabric.

For garments, the bath immersion may be effected in a bath process by placing the garment in a treatment vessel and immersing the garment in the aqueous bath 12. The garments are then preferably tumble dried 14 with heated air to the natural regain of the textile fibers. The natural regain of cotton is 8–10%, rayon 12–14%, and 1% for polyester so that drying time varies dependent upon whether the fabric is 100% cellulosic fiber or a blend with, for example, polyester, i.e. cotton/polyester; rayon/polyester, etc. After tumble drying, the garments are pressed to remove unwanted wrinkles 15 and directed through a heated curing oven 16 at a temperature of 325 to 330 degrees C. preferably, for at least eight to fifteen minutes to cure and crosslink the treatment composition which imparts water resistant, stain resistant and wrinkle-free properties without destroying the natural hand or feel of the fabric.

Alternatively, garments or bolts of fabric may be treated by a conventional continuous process, where they are conveyed through the bath, wrung dry using a nip and/or air dried to natural regain, and then cured by passage through a continuous processing oven. Where sheets of fabric are dried through passage through a nip, the nip may also serve to remove wrinkles thereby eliminating a separate pressing step.

After treatment, the fabric can withstand repeated washing with no significant degradation of the water resistant, stain resistant and wrinkle-free properties.

In one example, a bath was prepared by mixing equal parts of a 22% aqueous solution of DMDHEU with ZONYL® FMX. Acetic acid was added to adjust the pH to be between 5–5.5 and magnesium chloride was added as a catalyst. The resultant aqueous bath contained by weight: about 11% DMDHEU, about 7% ZONYL® PTFE, about 1.5% hexylene glycol, about 1% ethoxylated aliphatic alcohol, about 0.1% acetic acid, and about 4% magnesium chloride.

100% cotton fiber garments were immersed in the bath, dried to 8–10% moisture content, pressed to remove unwanted wrinkles, and cured to a temperature of about 325° C. for approximately 15 minutes. The resultant treated garments exhibited excellent water and stain resistant and wrinkle-free properties, even after repeated washing.

What is claimed is:

1. A fabric having water and stain resistant and wrinkle-free properties comprising at least 10% reacted hyroxyl group containing fibers wherein the fabric has been immersed in an aqueous bath containing 8–14% by weight dimethylol dihydroxy ethylene urea and 4–10% by weight polytetrafluorethylene and cured to provide polymer crosslinking.

2. A fabric according to claim 1 where the hydoxyl group containing fibers are cellulosic fibers.

3. A fabric according to claim 2 which is a cotton blend wherein the cellulosic fibers are cotton.

4. A fabric according to claim 2 which is 100% cotton.

5. A fabric according to claim 2 which is a rayon blend wherein the cellulosic fibers are rayon.

6. A fabric according to claim 2 which is 100% rayon.

7. A fabric according to claim 2 wherein the polytetrafluorethylene is ZONYL® PTFE.

8. A garment having water and stain resistant and wrinkle-free properties comprising the fabric according to claim 2.

9. A process for imparting water resistant, stain resistant and wrinkle-free properties to a fabric made at least in part of fibers having a hydroxyl group, such as cellulosic fibers, comprising:

immersing the fabric in an aqueous bath containing 8%–14% of a reactive modified ethylene urea resin and 4%–10% of a crosslinking polytetrafluorethylene to initiate a reaction of the urea resin with the hydroxyl groups to crosslink the polytetrafluorethylene; and heating the fabric to cure the reactants on the fabric.

10. A process according to claim 9, further comprising drying the fabric to its natural regain after immersion and then removing wrinkles from the fabric before curing.

11. The process according to claim 10 wherein said heating to cure is at a temperature of 325 degrees to 330 degrees C. for at least 8 to 15 minutes.

12. The process according to claim 10 wherein the fabric is immersed in a bath wherein said crosslinking polytetrafluorethylene is ZONYL® PTFE and said modified ethylene urea resin is dimethylol dihydroxy ethylene urea (DMDHEU).

13. The process according to claim 12 wherein the bath further comprises a buffering agent selected from a group of weak acids to adjust the pH of the bath in the range of 5 to 5.5 and a catalyst selected from a group of parabolic acids, whereby the catalyst speeds the reaction.

14. The process according to claim 13 wherein said buffering agent is acetic acid and said catalyst is magnesium chloride.

15. The process according to claim 9 wherein the fabric is immersed in a bath wherein said crosslinking polytetrafluorethylene is ZONYL® PTFE and said modified ethylene urea resin is dimethylol dihydroxy ethylene urea (DMDHEU).

16. The process according to claim 15 wherein the bath further comprises a buffering agent selected from a group of weak acids to adjust the pH of the bath in the range of 5 to 5.5 and a catalyst selected from a group of parabolic acids, whereby the catalyst speeds the reaction.

17. The process according to claim 16 wherein said buffering agent is acetic acid and said catalyst is magnesium chloride.

18. A fabric produced by the process according to claim 9.

* * * * *

UNITED STATES PATENT AND TRADEMARK OFFICE

CERTIFICATE OF CORRECTION

PATENT NO. : 6,372,674 B1
DATED : April 16, 2002
INVENTOR(S) : Ronnie Franklin Lack It is certified that error appears in the above-identified patent and that said Letters Patent is hereby corrected as shown below:

Column 2,
Line 66, after the words "cross linking of the", delete "1" and insert therefor -- hydroxyl --.
Line 27, after the word "degrees", delete "C." and insert therefor -- F. --.

Column 3,
Lines 55-56, after the word "325•", delete "C." and insert therefor -- F. --.

Column 4,
Line 31, after the words "330 degrees", delete "C." and insert therefor -- F. --.

Signed and Sealed this

Eighth Day of October, 2002

*Attest:*

*Attesting Officer*

JAMES E. ROGAN
*Director of the United States Patent and Trademark Office*